US011566338B2

(12) United States Patent
Konigshofen et al.

(10) Patent No.: US 11,566,338 B2
(45) Date of Patent: Jan. 31, 2023

(54) MULTICORROSION PROTECTION SYSTEM FOR DECORATIVE PARTS WITH CHROME FINISH

(71) Applicant: MacDermid Enthone GmbH, Langenfeld (DE)

(72) Inventors: Andreas Konigshofen, Leverkusen (DE); Ronny Kiefer, Klotze (DE)

(73) Assignee: MacDermid Enthone GmbH, Langenfeld (DE)

( * ) Notice: Subject to any disclaimer, the term of this patent is extended or adjusted under 35 U.S.C. 154(b) by 214 days.

(21) Appl. No.: 17/091,277

(22) Filed: Nov. 6, 2020

(65) Prior Publication Data

US 2021/0054520 A1 Feb. 25, 2021

Related U.S. Application Data

(62) Division of application No. 15/762,403, filed as application No. PCT/EP2016/072756 on Sep. 23, 2016, now Pat. No. 10,865,495.

(30) Foreign Application Priority Data

Sep. 25, 2015 (EP) ..... 15186917

(51) Int. Cl.

| | |
|---|---|
| ***B32B 3/00*** | (2006.01) |
| ***C25D 15/00*** | (2006.01) |
| ***C25D 3/06*** | (2006.01) |
| ***C25D 3/56*** | (2006.01) |
| ***C25D 5/14*** | (2006.01) |
| ***C25D 5/00*** | (2006.01) |

(52) U.S. Cl.

CPC ..... *C25D 15/00* (2013.01); *C25D 3/06* (2013.01); *C25D 3/562* (2013.01); *C25D 5/14* (2013.01); *C25D 5/617* (2020.08); *C25D 5/619* (2020.08); *C25D 5/623* (2020.08); *C25D 5/625* (2020.08); *C25D 5/627* (2020.08); *Y10T 428/24917* (2015.01)

(58) Field of Classification Search

None

See application file for complete search history.

(56) References Cited

U.S. PATENT DOCUMENTS

| | | | |
|---|---|---|---|
| 4,610,763 | A | 9/1986 | Law |
| 6,099,624 | A | 8/2000 | Martyak |
| 2003/0064244 | A1 | 4/2003 | Scarlin |
| 2012/0052319 | A1 | 3/2012 | Sugawara |

FOREIGN PATENT DOCUMENTS

| | | | |
|---|---|---|---|
| CN | 104775142 | A | 7/2015 |
| JP | 61-502964 | | 12/1986 |
| JP | H06240490 | | 8/1994 |
| JP | 07-278845 | | 10/1995 |
| JP | H08100273 | | 4/1996 |
| RU | 2100489 | C1 | 12/1997 |
| RU | 2500839 | C2 | 3/2013 |
| WO | 8504677 | | 10/1985 |
| WO | 09028182 | | 3/2009 |

OTHER PUBLICATIONS

Tremmel et al., "Methods to improve the corrosion performance of microporous nickel deposits," Plating and Surface Finishing. America Electroplaters Society, Inc., vol. 83, No. 10, pp. 24-27, Oct. 1, 1996.

*Primary Examiner* — Seth Dumbris

(74) *Attorney, Agent, or Firm* — Carmody Torrance Sandak & Hennessey LLP

(57) ABSTRACT

The invention relates to a corrosion protection layer system for metal surfaces, said layer system comprising as the two top most layers: a) a discontinuous nickel-phosphorus layer and b) a chromium layer plated from a trivalent chromium electrolyte solution, as well as to a method of producing such a layer system. The inventive layer system is capable to combine the good corrosion resistance of the nickel-phosphorus layer against sodium chloride with the protective power of the chromium layer from the trivalent plating process against magnesium and calcium salts, especially without the need for any post-treatment.

14 Claims, No Drawings

MULTICORROSION PROTECTION SYSTEM FOR DECORATIVE PARTS WITH CHROME FINISH

FIELD OF INVENTION

The present invention relates to a corrosion protection system for decorative parts with chrome finish, especially for exterior parts of automobiles. Furthermore, the present invention relates to a method for the production of a corrosion protection system on metal surfaces.

BACKGROUND OF INVENTION

The protection against corrosion of metal surfaces, like e.g. steel surfaces, tin surfaces, copper surfaces, aluminum surfaces, zinc or zinc alloy surfaces is of great commercial interest in various industries, like e.g. construction, marine, automotive, and aircraft industries. It is well-known in the art of surface technology to provide a metal surface of exterior parts with some type of corrosion protection. There are many established techniques which provide satisfactory corrosion protection performance. In modern times, the corrosion protection usually comprises more than one nickel layer in addition to a final chrome layer.

For example, a widely known technique to improve the corrosion resistance of metal surfaces, especially for exterior parts of automobiles, is the protection of the surface by an anti-corrosion nickel/chromium layer system. Such nickel and chromium layer systems are known in the art for a long time. For example, U.S. Pat. No. 3,471,271, which is hereby incorporated by reference in its entirety, describes the electrodeposition of a micro-cracked corrosion resistant nickel-chromium plate comprising at least three successive layers including, an underlying nickel electroplate, an overlying nickel strike electroplate, and a top bright chromium layer. Good corrosion resistance is achieved by using at least one amino acid in the electrolyte bath for the intermediate thin nickel strike layer, possibly in combination with the dispersion of certain bath-insoluble powders in a high-chloride nickel strike bath. Therefore, a nickel layer is obtained with micro-pores or micro-cracks which spreads the corrosion current across the surface and slows the corrosion rate. Such layers are also called discontinuous layers.

US 2012/0164479 A1, hereby incorporated by reference in its entirety, discloses a nickel and chromium layer system for providing metal surfaces with a discontinuous nickel layer. Here, the nickel layer derived from the nickel electrolyte is microporous where inorganic particles are incorporated in the micropores of the nickel layer. In addition, an organic acid salt is included in the nickel electrolyte bath in order to achieve micropores or microcracks in the plated nickel without the addition of inorganic solids.

However, the decorative nickel chromium corrosion protection layer systems described in the cited documents are all based on chromium plated from hexavalent chromium electrolytes. This is because only when the chromium layers are plated from hexavalent chromium solutions, can the layer systems pass the corrosion tests used in the automobile industry (i.e. the CASS (copper accelerated acetic acid salt spray) test with up to 96 h and the NSS (neutral salt spray) test with up to 480 h). In both tests sodium chloride is used as a corrosive substance and only systems with chromium layers plated from hexavalent plating solutions show sufficient corrosion resistance.

The principal ingredient in hexavalent chromium plating solutions is chromium trioxide (chromic acid). Chromium trioxide contains approximately 52% hexavalent chromium. The hexavalent oxidation state is the most toxic form of chromium. Hexavalent chromium is a known human carcinogen and is listed as a hazardous air pollutant. Due to low cathode efficiency and high solution viscosity, hydrogen and oxygen are produced during the plating process, forming a mist of water and entrained hexavalent chromium. This mist is regulated and undergoes tight emission standards. Apart from the EU "REACH" directive classifying hexavalent chromium as hazardous chemical, the EU has adopted the "End of Life Vehicle Directive," where hexavalent chromium is identified in the Directive as one of the hazardous materials used in the manufacture of vehicle. As such, it is generally banned from use in the manufacture of vehicles in the European Union states and has been since Jul. 1, 2003. Alternatives for the use of hexavalent chromium have been in increasing demand by the industry for some years now.

In some applications and at certain thicknesses, trivalent chromium plating can replace hexavalent chromium. Generally, the trivalent chromium plating rate and hardness of the deposit are similar to hexavalent chromium plating. Trivalent chromium plating has become an increasingly popular alternative for hexavalent plating in the metal finishing industry for a variety of reasons, including increased cathode efficiency, increased throwing power, and lower toxicity. The total chromium metal concentration in a trivalent chromium solution is usually significantly lower than that of a hexavalent plating solution. This reduction in metal concentration and the lower viscosity of the solution leads to less dragout and wastewater treatment. Trivalent chromium baths, as a result of their excellent throwing power, also produce fewer rejects and allow for increased rack densities in comparison to hexavalent chromium.

While trivalent chromium plating has a number of advantages, the plating also has drawbacks. Only corrosion protection systems including discontinuous nickel layers and chromium layers plated from hexavalent chromium plating solutions are able to pass the salt spray tests CASS and NSS whereas such plated from trivalent chromium do not. At present, this drawback is overcome by passivating the chromium layers from trivalent chromium solutions with hexavalent chromium posttreatment. Free lying nickel areas are subsequently passivated and the chromium layer itself is provided with a thicker passivating oxide layer. Although the overall amount of hexavalent chromium used in corrosion protection plating has been reduced, it still not possible to fully avoid hexavalent chromium solutions.

Furthermore, all corrosion protection systems including discontinuous nickel layers and subsequent chromium layers are prone to show reduced resistance against corrosion promoted by brake dust.

SUMMARY OF THE INVENTION

It is an object of the current invention to improve corrosion resistance against calcium chloride using chromium layers resulting from trivalent chromium plating solutions in combination with discontinuous nickel layers. Chromium layers plated from hexavalent chromium solutions have poor resistance against calcium chloride.

It is therefore an object of the invention to provide a corrosion protection system comprising discontinuous nickel and chromium layers, especially on metal substrate surfaces for exterior parts of automobiles.

It is another object of the invention to include a final chromium layer made from a trivalent chromium electrolyte bath that has improved corrosion resistance against thawing salt as well as against calcium chloride salt.

It is an additional object of the current invention to improve corrosion resistance against brake dust promoted corrosion.

Furthermore, it is an aspect of the invention to provide a method for the production of such a corrosion protection system.

Surprisingly, it was found that the object of the invention with respect to the composition is solved by a corrosion protection layer system for metal surfaces, said layer system comprising as the two top most layers:

a) a discontinuous nickel-phosphorous layer and
b) a chromium layer, over the discontinuous nickel-phosphorus, plated from a trivalent chromium electrolyte solution.

A method for the production of a corrosion protection layer system on metal surfaces is also provided herein, said method comprising the steps of:

a) providing a surface to be protected by a corrosion protection layer system,
b) plating on said surface a discontinuous nickel-phosphorus layer using a nickel electrolyte,
c) plating on said layer of step b) a chromium layer from a trivalent chromium electrolyte solution.

DETAILED DESCRIPTION OF THE PREFERRED EMBODIMENTS

The corrosion protection layer system provided by the invention is capable to provide, for the first time, a system that shows sufficient corrosion protection against thawing salt as well as against calcium chloride salt. In addition, the corrosion resistance against corrosion promoted by brake dust is improved. Simultaneously, the system allows the use of trivalent chromium plating solutions without having to be passivated, for instance with a layer from a hexavalent chromium electrolyte bath. It is now possible to avoid the hazardous hexavalent chromium solutions and provide a system that is fully in conformity with the EU regulations for the automobile industry, like the "End of Life Vehicle Directive".

By the use of the inventive layer system it is possible to combine the good corrosion resistance of the nickel-phosphorus layer against sodium chloride with the protective power of the chromium layer from the trivalent plating process against magnesium and calcium salts. The discontinuous nickel-phosphorus layer does not become passive in magnesium and calcium salt solutions and therefore protects the chromium layer above against corrosion.

The inventive layer system used in automobile decorative corrosion protection plating is plated over a two or preferably three layer underlying nickel system which is known in the art. Often the underlying nickel layers are formed as bright nickel layers and semi-bright nickel layers or as satin matte nickel layers and semi bright nickel layers.

The nickel-phosphorus layer plated above the two or three nickel layers underlying the inventive system, shows a corrosion current density that is lower than half of the corrosion current density of bright nickel, with an anodic current of 200-800 mV in 1 molar sodium chloride solution. Moreover, the nickel-phosphorus layer in a system of the present invention shows no passivation with an anodic current of 200-1,000 mV in a high molar calcium chloride solution.

It is advantageously possible with the inventive layer system to achieve good overall corrosion protection without any subsequent passivation of the chromium from the trivalent chromium electrolyte and without the need for any other subsequent post-treatment.

According to an embodiment of the invention the discontinuous nickel-phosphorus layer comprises phosphorus in an amount between 2.0 weight-% and 20.0 weight-%, preferably between 3.0 weight-% and 15.0 weight-%, most preferably between 5.0 weight-% and 12.0 weight-%, where the total weight of the nickel-phosphorus layer is 100 weight-%.

The nickel-phosphorus layer of the inventive system with phosphorus amounts between 2.0 weight-% and 20.0 weight-% improves the resistance against corrosion caused by sodium chloride salt in comparison to the previously known layer systems of microporous nickel and chromium from trivalent electrolytes. Lower amounts of phosphorus in the nickel layer do not give the corrosion protection to pass the CASS test and NSS test used in the automobile industry. Higher amounts of phosphorus in the nickel layer are wasteful and also do not show the required corrosion protection.

According to another embodiment of the invention, the discontinuous nickel-phosphorus layer comprises micropores and/or microcracks, preferably comprises between 100 and 1,000,000 micropores per $cm^2$ and/or between 10 and 10,000 microcracks per cm.

The micropores and/or microcracks in the nickel-phosphorus layer of the present invention lead to higher corrosion resistance of the overall layer system. The discontinuous structure of the nickel-phosphorus layer causes a discontinuous structure in the chromium layer plated above the bright or satin matte nickel layer. The micro-discontinuities across the surface spread the corrosion current and thus slow the corrosion rate in the less noble bright or satin matte nickel layer. The corrosion resistance of the layer system improves with higher amounts of micro-discontinuities and when the micro-discontinuities are more evenly distributed.

According to another embodiment of the invention the discontinuous nickel-phosphorus layer comprises inorganic solids co-plated from the nickel electrolyte solution. The inorganic solids can be chosen from the group comprising talcum, china clay, aluminum oxides, silicon oxides, titanium oxide, zirconium oxide, carbides and nitrides of silicon, boron and titanium, and mixtures thereof.

The use of inorganic solids in the electrolyte causes the inorganic particles to be incorporated in the nickel-phosphorus layer that give the micropore and/or microcrack structure of the layer. A discontinuous layer is formed that contains the incorporated inorganic particles, presumably also in the micropores and/or microcracks. As a result of the incorporation of the inorganic particles in the inventive layer system, a much improved protection against corrosion promoted by brake dust is obtained.

According to another embodiment of the invention, the chromium layer plated from a trivalent chromium electrolyte solution contains between 50 weight-% and 98 weight-% chromium and between 2 weight-% and 50 weight-% of an element chosen from the group consisting of C, N, O, S, P, B, Fe, Ni, Mo, Co, and mixtures thereof, wherein the weight-% always add to 100% and related to the total weight of the plated chromium layer.

According to an embodiment of the invention the chromium layer plated from a trivalent chromium electrolyte solution is amorphous, crystalline, microporous, or microcracked.

The invention relates further to a method for the production of a corrosion protection layer system on metal surfaces, said method comprising the steps of:

a) providing a surface to be protected by a corrosion protection layer system, b) plating on said surface a discontinuous nickel-phosphorus layer, c) plating on said layer of step b) a chromium layer from a trivalent chromium electrolyte solution.

By the use of the inventive method layer system it is possible to combine the good corrosion resistance of the nickel-phosphorus layer against sodium chloride, with the protective power of the chromium layer from the trivalent plating process against magnesium and calcium salts. The discontinuous nickel-phosphorus layer does not become passive in magnesium and calcium salt solutions and therefore protects the chromium layer above against corrosion. This can be advantageously achieved by use of the inventive method without the need for any post-treatment of the final chromium layer, either by passivation or any other means.

In step a) of the inventive method, decorative corrosion protection plating used for exterior automobile parts generally is plated over a two or preferably three layer underlying nickel system which is widely known in the art. The surface to be protected in step a) is the final nickel layer of the underlying nickel system. Often the underlying nickel layers are formed as bright nickel layers and semi-bright nickel layers or as satin matte nickel layers and semi bright nickel layers on the metal surface.

Electroplating with nickel electrolytes is known to the skilled person in principle, and usual process measures for electroplating with nickel and phosphorus electrolytes can also be applied to step b) of the present inventive method. Suitable nickel compounds include various nickel salts, especially nickel chloride and nickel sulfate as well as nickel acetate. The content of the nickel compound in the nickel electrolyte bath of step b) is preferably from 0.5 mol/l to 2.0 mol/l and especially preferred from 1.0 mol/l to 1.5 mol/l.

According to the inventive method, the nickel electrolyte solution for plating step b) has a phosphorus containing additive in a concentration between 0.01 mol/l and 1.0 mol/l, preferably between 0.05 mol/l and 0.25 mol/l. Any soluble phosphorus compounds, with phosphorus in a valence state lower than +5, can be used in step b) of the inventive method. Preferably, the nickel electrolyte solution for plating step b) comprises a hypophosphite or an orthophosphite.

In a preferred embodiment of the inventive method wherein the nickel electrolyte solution for plating step b) has a pH in the range of between 1.0 and 5.0, preferably between 1.1 and 2.0. By adjusting the pH value of the nickel electrolyte bath in step b) it is possible to control the amount of phosphorus in the resulting nickel-phosphorus layer. Lower operational pH levels increase the phosphorus content in the deposit while decreasing the plating deposition rate. When the electrolyte has a pH between 1.1 and 2.0, the amount of phosphorus co-plated in the layer results in advantageous corrosion protection, especially against sodium salt promoted corrosion. Adjustment of the pH value of the bath solution can be achieved by addition of acids or alkalis.

The amount of phosphorus co-plated with nickel from the nickel electrolyte bath can also be adjusted with variation of other parameters besides the pH value of the bath solution as it is known in the art.

According to another embodiment of the inventive method, the nickel electrolyte solution for plating step b) comprises insoluble inorganic particles with a mean diameter (d50) of between 0.01 μm and 10.0 μm, preferably between 0.3 μm and 3.0 μm. The method of measuring the mean diameter of particles (d50) most often used for the present diameter range is laser diffraction. Measurements should be carried out in accordance with the international ISO 13320 standard.

The insoluble inorganic particles in the nickel electrolyte solution for plating step b) can preferably be chosen from the group consisting of $SiO_2$, $Al_2O_3$, $TiO_2$, BN, $ZrO_2$, talcum, china clay, or mixtures thereof.

Any insoluble particles that can be co-deposited to lower surface tension can be used in the inventive method. For example, a final surface tension of the nickel electrolyte bath between 20 and 60 mN/m and preferably between 30 and 50 mN/m, is desirable.

The nickel electrolyte solution for plating step b) comprises a pH buffer, preferably boric acid, in a concentration between 0.1 mol/l and 1.0 mol/l, preferably between 0.5 mol/l and 0.8 mol/l.

In step b) the electroplating of the nickel phosphorus layer can be carried out with a current density of from 0.1 to 5.0 $A/dm^2$, preferably with a current density of from 1.0 to 2.0 $A/dm^2$. The parts to be plated in step b) are contacted with the nickel phosphorus electrolyte bath at a temperature of from 40° C. to 70° C., preferably from 55° C. to 60° C. The resulting nickel phosphorus layer is plated in a thickness of from 0.1 μm to 5.0 μm, preferably in a thickness of from 0.5 μm to 2.0 μm.

In step c) of the inventive method the chromium layer is applied in a preferred thickness of from 0.1 μm to 5.0 μm, and preferably in a thickness of from 0.2 μm to 0.8 μm.

The plating electrolyte solution of step c) can be chromium sulfate-based and/or a chromium chloride-based bath. Trivalent chemistries use low concentrations of chromium in the bath, generally 5.0-25 g/L of trivalent chromium. The chromium plating process step c) can utilize pulse and pulse reverse waveforms for trivalent chromium plating. The process step c) generally operates at temperatures of 27° C. to 65° C., so some heating above room temperature can be necessary.

The trivalent chromium bath can be operated within a pH range between 1.8 and 5.0, preferably the pH value is between 2.5 and 4.0. Additives can be used to regulate the pH value of the bath, the surface tension, and to control the precipitation of chromium salts as well as to prevent the oxidation to hexavalent chromium in the solution. For example, an additive such as thiocyanate, monocarboxylate, and dicarboxylate functions as a bath stabilization complexing agent allowing the plating to be stably continued. An additive such as an ammonium salt, alkali metal salt, and alkaline earth metal salt functions as an electricity-conducting salt allowing electricity to easily flow through the plating bath to increase plating efficiency. Furthermore, a boron compound functions as a pH buffer by controlling pH fluctuations in the plating bath, and a bromide has the function of suppressing generation of chlorine gas and production of hexavalent chromium on the anode.

Advantageously, drag-in of chloride and/or sulfate ions from previous nickel-plating operations into the trivalent chromium process is tolerated. By contrast, chloride and sulfate drag-in upset the catalyst balance in a hexavalent chromium process.

The inventive method as well as the inventive corrosion protection layer system may be used to provide effective corrosion protection for exterior automotive parts.

The invention is additionally explained by the following ex pies while the inventive idea is not limited to these embodiments in any way.

EXAMPLES

Three samples of an exterior automobile trim part are electroplated in identical ways. The trim parts are made from ABS and subsequently plated with copper, semi bright nickel and bright nickel. The following main requirements were fulfilled for all samples: copper≥25 μm, semi bright nickel≥7.5 μm, bright nickel≥7.5 μm, potential of semi brig nickel≥100 mV more noble than potential of bright nickel.

Sample 1 (comparative sample) is plated with a microporous nickel layer (2.0 μm and 50 mV more noble than bright nickel) and a chromium layer (0.3 μm) electrodeposited from a hexavalent chromium electrolyte. This sample passes 480 h NSS test and 48 h CASS test according to DIN EN ISO 9227. PV 1073 describes a test method for calcium chloride induced chrome corrosion (PV 1073-A) and break dust accelerated nickel corrosion (PV 1073-B). The above mentioned sample passes PV 1073-B, but fails in PV 1073-A.

Sample 2 (comparative sample) is plated with a microporous nickel layer (2.0 μm and 50 mV more noble than bright nickel), a chromium layer (0.3 μm) electrodeposited from a trivalent chromium electrolyte, and then passivated with a hexavalent chromium containing solution. This sample passes 48 h CASS test and PV 1073-A, but fails in 480 h NSS test and PV 1073-B.

Sample 3 (according to the present invention) is plated with a microporous nickel-phosphorus layer according to table 1 and a chromium layer electrodeposited from a trivalent chromium electrolyte without any post-treatment. This sample passes 480 h NSS test, 48 h CASS test, PV 1073-A, and PV 1073-B.

TABLE 1

| | | | |
|---|---|---|---|
| Time [min] | 4 | Nickel [mol/l] | 1.3 |
| Temperature [° C.] | 55 | Sulfate [mol/l] | 0.75 |
| Current density [A/dm$^2$] | 2.0 | Acetate [mol/l] | 0.5 |
| pH | 1.4 | Chloride [mol/l] | 0.6 |
| Surface tension [mN/m] | 45 | Boric acid [mol/l] | 0.75 |
| Thickness [μm] | 1.5 | Phosphorus acid [mol/l] | 0.1 |
| Phosphorus [weight %] | 10.5 | Al2O3 (d50 1 μm) [g/l] | 0.1 |
| Micro-porosity [pores/cm$^2$] | 10,000 | SiO2 (d50 2.5 μm) [g/l] | 0.8 |

The invention claimed is:

1. A method for the production of a corrosion protection layer system on metal surfaces, said method comprising the steps of:

a) providing a surface to be protected by a corrosion protection layer system, b) plating on said surface a-discontinuous nickel-phosphorus layer comprising inorganic solids by an electroplating process from a nickel electrolyte solution, wherein the discontinuous nickel-phosphorus layer comprises micropores and/or microcracks between 100 and 1,000,000 micropores per cm$^2$ and/or between 10 and 10,000 microcracks per cm, and wherein the nickel-phosphorus layer comprises phosphorus in an amount between 2.0 wt. % and 20.0 wt. %, wherein the total weight of the nickel-phosphorus layer is 100 wt. %; and c) plating on said layer of step b) a chromium layer rom a trivalent chromium electrolyte solution by an electroplating process.

2. The method according to claim 1, wherein the nickel electrolyte solution for plating step b) has a pH between 1.0 between 5.0.

3. The method according to claim 2, wherein the nickel electrolyte solution has a pH between 1.1 and 2.0.

4. The method according to claim 1, wherein the nickel electrolyte solution for plating step b) has a phosphorus containing additive in a concentration between 0.01 mol/l and 1.0 mol/l.

5. The method according to claim 4, wherein the nickel electrolyte solution for plating step b) has a phosphorus containing additive in a concentration between 0.05 mol/l and 0.25 mol/l.

6. The method according to claim 4, wherein the phosphorus containing additive is a hypophosphite or an orthophosphite.

7. The method according to claim 1, wherein the nickel electrolyte solution for plating step b) comprises insoluble inorganic particles with a mean diameter (d50) of between 0.01 μm and 10.0 μm.

8. The method according to claim 7, wherein the nickel electrolyte solution for plating step b) comprises insoluble inorganic particles with a mean diameter (d50) of between 0.3 μm and 3.0 μm.

9. The method according to claim 7, wherein the insoluble inorganic particles in the nickel electrolyte solution for plating step b) are selected from the group consisting of $SiO_2$, $Al_2O_3$, $TiO_2$, BN, $ZrO_2$, talcum, china clay, or mixtures thereof.

10. The method according to claim 1, wherein the nickel electrolyte solution for plating step b) comprises boric acid.

11. The method according to claim 10, wherein the boric acid concentration is between 0.1 mol/l and 1.0 mol/l.

12. The method according to claim 11, wherein the boric acid concentration is between 0.5 mol/l and 0.8 mol/l.

13. The method according to claim 1, wherein the surface to be protected by a corrosion protection layer system in an exterior automotive part.

14. The method according to claim 1, wherein said chromium layer plated from a trivalent chromium electrolyte solution is amorphous, crystalline, microporous, or microcracked.

* * * * *